United States Patent [19]

Pruit

[11] Patent Number: 5,054,854

[45] Date of Patent: Oct. 8, 1991

[54] INFLATABLE STRUCTURE SECURED BY TENSION

[76] Inventor: John D. Pruit, 3009 Glen Hollow Circle, Carrollton, Tex. 75007

[21] Appl. No.: 576,377

[22] Filed: Aug. 31, 1990

[51] Int. Cl.[5] ..... A47C 7/38

[52] U.S. Cl. ..... 297/284; 297/DIG. 3; 297/357

[58] Field of Search ..... 294/982, 289, 469, 397, 294/395, 470, 471, DIG. 3; 448/295.1, 298; 5/431–434, 436, 437

[56] References Cited

U.S. PATENT DOCUMENTS

| | | | |
|---|---|---|---|
| 2,605,818 | 8/1952 | Dabbs et al. | 297/397 X |
| 4,206,945 | 6/1980 | Kiefferstein | 297/397 X |
| 4,348,037 | 9/1982 | Law et al. | 297/483 X |
| 4,534,593 | 8/1985 | Ojala | 297/284 |
| 4,630,865 | 12/1986 | Ahs | 297/284 |
| 4,711,492 | 12/1987 | Asbjornsen et al. | 297/284 |
| 4,862,536 | 9/1989 | Pruit | 297/284 |
| 4,981,325 | 1/1991 | Zacharkow | 297/284 |

*Primary Examiner*—Peter A. Aschenbrenner
*Attorney, Agent, or Firm*—Hubbard, Thurman, Tucker & Harris

[57] ABSTRACT

An inflatable bladder or plurality of bladders has a connection for a flexible strap-like position member having a portion constrained in a pocket affixed to the bladder and is adjustably positionable along the length of the positioning member and securable thereto by frictional engagement by tensioning extension of the wall of the bladder resulting from inflation to a tensioned condition wherein the strap is repositionable in an untensioned condition of the bladder.

39 Claims, 1 Drawing Sheet

INFLATABLE STRUCTURE SECURED BY TENSION

BACKGROUND OF THE INVENTION

1. Field Of The Invention

The present invention relates generally to an inflatable cushion like device positionable along the length of a strap or straps and securable by inflation alone or with other inflatable cushions to provide back support or serve as a buoy.

2. Description of the Prior Art

Seating is a problem in conveyances of every kind because of the differences in individuals and the fact that various individuals must use the same seats, such as in buses or airplanes. The same is true in private automobiles which are made for the mass market. Additionally, a number of people have particular conditions which are aggravated unless they are seated with support for the spine, properly adjusted to fit them.

These problems have frequently been addressed by means of various kinds of cushions or inflatable cushions some of which are specially shaped to fit the lumbar area of the spine but it is difficult to accommodate a variety of conditions, especially including conditions which may affect the upper back or neck area. Thus there are medical reasons for improved back support devices as well as comfort reasons.

The prior art does have examples whereby horizontally elongated cushions have been connected to each other by a flexible member, such as a strap, but it has not been convenient to arrange them vertically on a strap or straps so that they are easily adjustable and at the same time are fixed securely in the desired position. Various types of conventional fasteners may be used or the straps may be contained in belt loops and bunched to provide some resistance to sliding. The latter presents the difficulty that, if they are tight enough to be held securely, they are difficult to slide. An improved way to attach a plurality of cushions movable on flexible members, such as straps, has been needed.

It is therefore an object of the present invention to provide an improved slidably adjustable connection between an inflatable cushion or cushions and a flexible elongate member or members, such as a strap, which may be used to support one cushion above the other in a securely adjusted and fixed position. It is further an object to provide an economical construction of a back rest which is deflatable into a small package easily contained in a brief case or suit case for convenient transport in traveling. A further object of the invention is to provide an improved connection for an inflatable buoy which is adjusted and secured to an anchor strap at the appropriate depth and readjustable by partial deflation and secured by reinflation.

SUMMARY OF THE INVENTION

The invention utilizes a connection between an inflatable bladder and an elongate flexible positioning member wherein the bladder has a tensioned extensible wall in an inflated condition and is deflatable to an untensioned condition of said wall for slidable adjustment on the flexible positioning member in the untensioned condition. An extensible pocket is fixed to the outer wall surface of the bladder at spaced apart seams, the pocket having a panel across said seams for receiving a section of flexible elongate positioning member in sliding contact between the pocket and the wall in the untensioned condition, the pocket being extensible with said wall in the inflated condition of the bladder to compressibly secure, a section of a positioning member in said pocket, between the pocket and the wall.

In one embodiment the bladder may be used as a buoy having an extensible pocket in which an anchor rope or strap is disposed for adjustment to the depth of the water. With the bladder in the untensioned condition, the anchor rope or strap may be slidably positioned to place the buoy at the water surface with the anchor attached to the rope or strap and resting on the bottom. When the bladder is inflated the buoy is secured to the anchor rope or strap in frictional engagement between the pocket and the wall of the bladder without tying any knots. A second extensible pocket may be provided on the bladder, preferably in line with the first pocket, so that each of said pockets can receive and compressibly secure, in the inflated condition of the bladder, a separate section of the same elongate positioning member. Both pockets grip the rope or strap simultaneously upon inflation of the buoy, thus avoiding any change in the position of the buoy along the length of rope or strap. The depth is easily adjusted for use at a different location by releasing some inflation which returns the pocket and the wall of the bladder to the untensioned condition whereby the buoy can be moved along the length of the rope or strap and resecured when the buoy is reinflated to the tensioned condition.

In another embodiment of the invention a pair of elongate flexible positioning members are oriented generally vertically spaced apart up along the back of a seat or chair. An elastic band may be placed around the head rest from which the positioning members may be suspended. An inflatable elongate pillow-shaped bladder is adjustably positionable along the length of the positioning members, the bladder having a tensioned extensible wall in an inflated condition, the wall forming a front surface for supporting a portion of a seated persons back and an opposite back surface in contact with the back of a seat, and being deflatable to an untensioned condition of said wall, and to a flat condition upon complete deflation. The back surface of the inflatable bladder has affixed thereto a pair of extensible pockets spaced apart across the elongate back surface of the bladder, each of the pockets being fixed to the back wall at spaced apart seams forming a pocket having a panel across said seams for receiving a section of one of the flexible elongate positioning members in sliding contact between the pocket and the wall surface in the untensioned condition, each of the pockets being extensible with said wall in the inflated condition of the bladder to compressibly secure in frictionable engagement a section of one of the positioning members in said pockets. This forms an H-shaped arrangement with the bladder horizontally oriented across the back of the seat and being positionable and securable along the positioning members vertically.

A second bladder of similar construction may be located above the first inflatable bladder in vertical orientation, with each of the pair of straps running through an identical pocket on the back surface of the second inflatable bladder for vertical adjustment to a comfortable position of the back in the untensioned condition and being compressibly secured to a section of the positioning members in said pockets in a tensioned condition resulting from inflation. The pockets on the bladders are positionally aligned with the vertically running straps. A third inflatable bladder of the same construction as the other bladders may be used, having a pair of extensible pockets each of which surrounds one of the positioning members. These pockets may also be adjustably positioned in the untensioned condition or compressibly secured in the tensioned condition resulting from inflation. The third adjustable bladder preferably includes an uninflatable area between the front and back surfaces above a neck engaging bridge portion into which the user's head is comfortably nested while seated with the back support in place. The pockets on the back surface of the three inflatable bladders cooperate in lined up relationship with the flexible elongate positioning members, preferably straps, so that the bladders which serve as back supporting cushions in the untensioned condition may easily be positioned vertically with respect to the straps. The bladders are equipped with a means for inflation which permits the user to secure them by inflation to the strap compressing condition so that they are most comfortably suited for that user's anatomy.

The three inflatable bladder cushions are conveniently quickly deflatable by opening the means for inflation. The bladders are thus easily flattened and stacked on each other for ease in transporting, in a flattened condition with the straps still in place, such as when changing planes for example. The cushions and straps occupy a very small volume and are quite light in weight so as to comfortably fit even in a portion of an attache case. The bladders are generally less than the width of the typical seat and only about one third as high as they are long in the inflated condition. Each is quickly inflated by a few breaths.

DESCRIPTION OF THE PREFERRED EMBODIMENT

Figure 1:
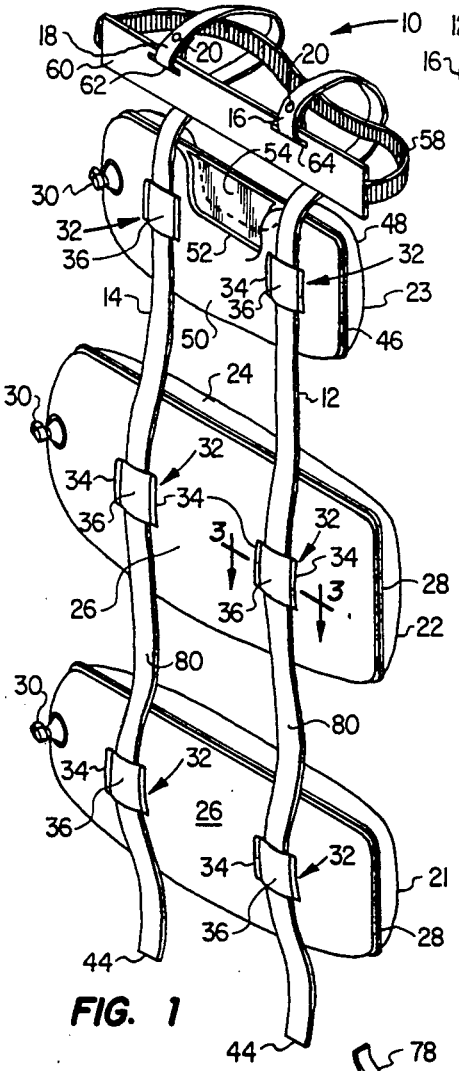
FIG. 1 is a perspective view showing the back surface of three inflatable cushions in assembly with the elongate members.
Figure 2:
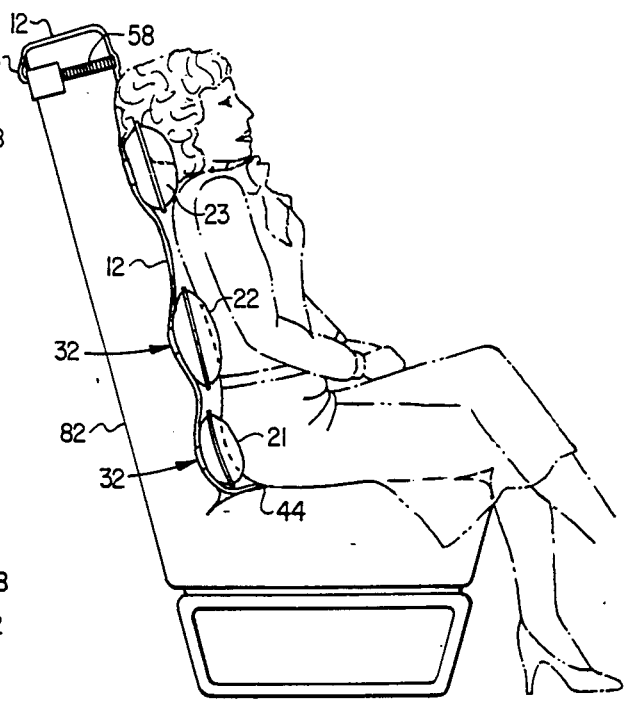
FIG. 2 shows the assembly of FIG. 1 in inflated position behind a on a seat.

A complete back support assembly is generally designated by the reference numeral 10 in FIG. 1, and seen from one side as applied to an airline chair in FIG. 2. A pair of flexible elongate positioning members 12 and 14 are seen spaced apart in FIG. 1, vertically oriented. Positioning member 12 is seen in the side view of FIG. 2. Positioning members 12, 14 are shown as thin rectangular-shaped straps which are of uniform cross-section throughout. Straps 12 and 14 have turned over end portions 16 and 18 respectively each having a releasable fastener 20 which forms a loop in the ends. The ends may be looped over the top of a chair back and connected to a horizontally oriented strap 60. This will hold them in vertical orientation lying along the back rest of a chair seat.

An inflatable bladder such as bladder 22, has a front surface 24 partially hidden in FIG. 1 and an opposite back surface 26 which are joined at a seam 28. Inflatable bladder 22 is made from wall 42 (FIG. 3) which is joined at a seam 28 which continues all around the periphery and is preferably formed by heat sealing a front wall panel and a back wall panel in an airtight seal. One of the panels is provided with an air inlet and discharge valve 30 which permits a user to inflate the bladder and to completely deflate the bladder so that the bladder will lie flat on a surface with the front panel and the rear panel of the wall in contact on their inside surfaces to minimize the amount of space occupied by the deflated bladder. Bladder 22 has an elongate pillow-shape which is sized to provide support across the user's back in a horizontal orientation. The horizontally oriented axis as indicated in FIGS. 1 and 2 is conveniently about three times longer than the height in the vertical direction.

On the elongate back surface 26 of bladder 22 are a pair of extensible pockets designated generally by the reference numeral 32. The pockets 32 are fixed to the surface of the back wall of the bladder at spaced apart seams 34. Pockets 32 have a panel 36 extending across between the seams 34 of each pocket for receiving a section of a flexibly elongate positioning member, such as member 12, in sliding contact between the pocket and the panel in an untensioned condition.

Figure 3:
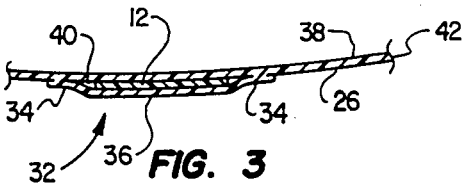
FIG. 3 is a cross-sectional view of one of the pockets containing positioning member.

Referring now to FIG. 3, pocket 32 is seen fixed to back wall surface 26 of bladder wall 42, having an interior surface 38 on the interior of bladder 22. Panel 36 is seen as fixed by means of seams 34 to back wall surface 26 of bladder 22. This is accomplished with a "patch" of material placed flat on surface 26 and joined by sealing along seams 34, leaving an unsealed panel 36. A flexible elongate positioning member, in this case member 12, is seen being held with its inside surface in contact with surface 26 and its opposite outside surface 80 in contact with the inside surface of panel 36. FIG. 3 indicates that the panel 36 forms a space 40 defined by its inside surface, the seams 34 and surface 26 with the strap in place. Strap 12 of rectangular cross-section preferably occupies almost all of the space 40 because it is nearly as wide as the spaced apart seams 34 in FIG. 3. Stretching of the wall 42 in a direction normal to the long axis of a strap, such as strap 12, creates a gripping action which grips strap 12 between wall 42 and panel 36. This creates frictional engagement between the contacting surfaces which securely holds the strap from sliding relative to the bladder.

There is a tensioned condition and an untensioned condition in the wall 42 and the pocket 32. The wall 42 of bladder 22 is in the untensioned condition when it is deflated to a flattened condition. Pocket 32 for economical construction is formed of a patch of material similar to the material which comprises wall 42. It is preferably made from the same flexibly extensible material as wall 42.

When a strap, such as strap 12 is inserted, panel 36 is pushed away from surface 26 and creates the opening 40. In the untensioned condition, strap 12 or the corresponding strap 14, are slidingly frictionally engaged so that bladder 22 can be adjusted in the vertical direction of the arrows in FIG. 1 up or down. Since the bladder is very light in weight, there is enough friction to keep the untensioned bladder in position, but it is easily adjusted by sliding the strap 12 through the pocket 32 to reposition bladder 22.

The untensioned condition continues as the bladder is partially inflated so that even a partially inflated bladder remains positionable in sliding contact with a flexible elongate positioning member in pocket 32. When the slack is removed from the material of wall 42 as the bladder is further inflated, a point is reached where additional inflation begins to increase the internal pressure in bladder 22, which results in a slight extension of wall 42 in all directions. Back wall surface 26 also becomes arcuate and the locations of the spaced apart pockets 32 can be thought of as lying along an imaginary arc along the arcuate surface of the bladder in at least the vertical and horizontal directions indicated by the section marks of the FIG. 3 shown in FIG. 1. At the same time the extension of the wall 42, particularly in the cross direction perpendicular to the line of the seams 34, also causes extension of the pocket 36 which tends to compressibly secure a section of the positioning member in the pocket 32.

The strap 12 is securely held in position frictionally engaged between panel 36 of pocket 32 and surface 26 of wall 42 to secure bladder 22 in place on the strap. This locking of the bladder to the strap is an effect which is increased as the pressure in bladder 22 is increased further by additional inflation. It is not necessary to inflate the bladder beyond a firm shape to secure the desired locking effect. Conversely, when bladder 22 is deflated by letting air escape from valve 30 to a partially inflated untensioned condition, a strap, such as strap 12, is again slidably and adjustably positionable with respect to bladder 22.

The back rest assembly 10 of FIG. 1 actually includes first inflatable bladder 21, second inflatable bladder 22 and third inflatable bladder 23 spaced from bottom to top in vertical orientation with spaced apart elongate flexible positioning members 12 and 14 serving to tie the units together. For purposes of disclosure, bladder 21 will be treated as being identical to bladder 22 except that it should be recognized that the relative dimensions of bladder 21 may be altered to make it bigger or smaller than bladder 22. Straps 12 and 14 may have short end portions 44 extending below bladder 21 to permit a full adjustment of the assembly to seats of different back heights. The ends may simply be placed under the wearer in position on a chair seat.

Bladder 23 may preferably be slightly smaller in dimensions to make a smaller pillow-like cushion, which because of its smaller size will have a smaller peripheral seam 46 all around where a front panel having a front surface 48 and a back panel having back surface 50 are connected. In addition a key hole seam 52 separates from peripheral seam 46 at the upper outer edge producing an uninflatable panel 54 which may be left in place as indicated in FIG. 1 or cut away to produce a U-shaped bladder with a head supporting nesting opening centered in the arms of the U.

The assembly is completed with a securing strap having an elastic band 58 and a non-elastic portion 60 which may be made of cloth. Portion 60 has spaced apart openings 62 on the left side and 64 on the right side which receive the end portions 16, 18 of respective straps 12, 14.

Figure 4:
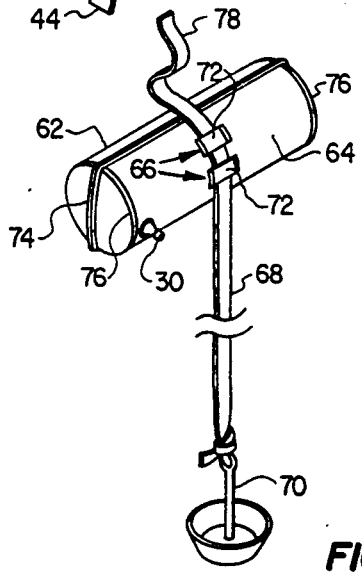
FIG. 4 illustrates use of the pockets on a buoy attached to an anchored strap.

In FIG. 4 is an inflatable bladder 62, which is illustrated as a cylindrical-shaped bladder although it could be made in a different shape. It has an arcuate surface 64 when inflated which has a pair of pockets generally designated by the reference numeral 66, spaced apart from each other and located in line with a anchor strap 68 tied to an anchor 70. Pockets 62 are constructed identical to pockets 32 except that they are arranged spaced apart one above the other rather than being spaced apart side by side. Extensible panel 72 is affixed to the arcuate surface by a pair of spaced apart seams. Pockets 66 have the same construction as indicated previously in FIG. 3. Bladder 62 has a peripheral seam 74 which effectively divides the bladder into two halves. End seams 76 provide a cylindrical end. Strap 68 passes through each of the aligned pockets 66, having a free end 78 which allows for depth adjustment.

When the bladder 62 is uninflated or partially inflated up to the point where it just rounds out its shape, the surface 64 is in an untensioned condition of the wall of which it is part. Up until this point, bladder 62 is slidingly adjustably positionable along the elongate strap 68 to permit adjustment of the distance between the bladder 62 and the anchor 70. Upon further inflation, a section of strap 68 is compressibly secured in the pocket by the extension of surface 64 of the wall, the extensión of panels 72 and the inflation pressure pushing the surface 64 toward the inside surface of the panel 72. The inside surface of panel 72 is in contact with one surface of the strap which has a rectangular cross-section as shown. However, strap 68 could comprise a rope and the rope would also, when passed through between panels 72 and surface 64, be adjustably positionable and compressibly secured by friction, since the effect does not depend upon the rectangular shape of the elongate flexible positioning member 68. The gripping effect is however enhanced somewhat by having a larger contact area between the bladder, pocket and positioning member or strap.

The device of FIG. 4 may be used as a racing buoy wherein under partial inflation it can be adjustably positioned at the surface of the water after the anchor has been set. Then anchor strap 68 can be secured and locked by further inflation of bladder 62 in the same manner as has been described for FIG. 1. Having two or more of the pockets 66 in line provides additional holding power if needed. When it is desired to move the buoy to another location, it may be picked up in a boat and deflated slightly to permit adjustment to the surface of the water at a different location and locked in position by reinflation of the bladder 62 at the new location. This provides a convenient method of quickly placing buoys without tying any knots which are securely held yet easily adjustable.

In use, the wall of the inflatable bladders is preferably made from a plastic material, such as vinyl plastic which is flexible and has a tendency to extend slightly when stretched. For the sake of economy, the bladders are seamed by heat sealing two pieces together in the flat condition. All of the peripheral seals can be made in one operation including the creation of the uninflatable panel 54 in bladder 23. The front and back surface of the bladders are preferably made of the same material having the same thickness. The straps and panels are conveniently made of the same material. This adds to the economical construction and light weight of the completed unit shown in FIG. 3 which can be made to weigh considerably less than one pound. The straps 12, 14 must be made long enough to extend vertically up the back of the longest seat back 82 expected to be encountered, to provide complete adjustment for the lower most first bladder 21.

The plastic material from which the bladders, panels and straps are made may include a textured outer surface formed in like the pattern of a piece of cloth, which provides a roughened surface. A roughened surface may be provided on the inside surface of panels 36, 72 and on the surface in contact therewith on straps 12, 14 and 68. The roughened surface provides additional frictional engagement in the tensioned condition of the bladders which helps to hold more securely. Enough frictional engagement is provided even by a smooth vinyl plastic surface, that a textured or roughened surface is not required to enable the unit to function in the intended manner. A hard slick or lubricated surface on the engaging parts is to be avoided.

The pockets 32, 66, can be made of a different material than the surface 26 of wall 42 but it should be compatable for heat sealing the seams 34. This is the most desirable and economical method of manufacture. Even if the panels 36, 72 are not extensible it may be possible to provide some frictional holding by means of the extensible panel 26, 50 and the arcuate contact surface provided by inflation, to secure the back rest 21, 22 and the head rest 23 in position, though it is more desirable that panels 36, 72 be extensible as well because unextensible panels tend to prevent the extensible surfaces 26, 50, 64 from extending to provide the full compressive frictional engagement force to grip the strap.

It is also possible to enhance the frictional engagement by providing a friction enhancing coating to mating contact surfaces of the pocket and the strap, such as the inside surface of the panel members and the outside surface 80 of the straps 12, 14. A friction enhancing layer or coating on the opposite surface of the straps 12, 14 and possibly on the bladders 21, 22 and 23 could also enhance the frictional engagement in the tensioned condition. The bladders in FIG. 1 may conveniently be covered by a suitable close fitting soft cloth cover which enhances the feel and may be removable for cleaning. Such a cover must have openings to permit the placement of the straps and to allow the straps to slide in the pockets when adjustment is required.

I claim:

1. An inflatable bladder adjustably positionable along an elongate flexible positioning member comprising a bladder having a tensioned extensible wall in an inflated condition, being deflatable to an untensioned condition of said wall; and an extensible pocket fixed to said wall at spaced apart seams, the pocket having a panel across said seams for receiving a section of a flexible elongate positioning member in sliding contact between the pocket and the wall in the untensioned condition, the pocket being extensible with said wall in the inflated condition of the bladder to compressibly secure a section of a positioning member in said pocket.

2. The combination of claim 1 wherein the bladder has one extensible pocket in a first location and another extensible pocket in a second location spaced from said first location, the first and second locations being centered along an imaginary arc along the surface of the bladder when inflated.

3. The combination of claim 1 wherein the bladder has one extensible pocket in a first location adjacent another extensible pocket in a second location in line with the first location and operably arranged so that each of said pockets can receive and compressibly secure, in the inflated condition of the bladder, a separate section of the same elongate positioning member.

4. The combination of claim 1 wherein the bladder has two extensible pockets spaced apart from each other, each pocket being placed for receiving and compressibly securing, in the inflatable condition of said bladder, a section of two separate elongate positioning members.

5. The combination of claim 1 further including an elongate flexible positioning member, positionable in said pocket for sliding contact between the pocket and the wall of the bladder in the untensioned condition and compressibly securable at any section along its length by the extension of the pocket member in cooperation with extension of the wall member upon inflation of the bladder.

6. The combination of claim 5 wherein the elongate flexible positioning member is a lengthy strap of generally rectangular cross-section which occupies most of the space between said seams.

7. The assembly of claim 6 wherein the wall of the bladder is made of plastic material having a outer surface roughened by a pattern and said strap is made of a similar plastic material.

8. The combination of claim 7 wherein at least the inside surface of the panel has a surface roughened by a pattern and is made from a plastic material.

9. A combination of claim 8 wherein the bladder, the strap and the panel are all made from the same material.

10. The combination of claim 3 further including an elongate flexible positioning member, positionable in said pocket for sliding contact between the pocket and the wall of the bladder in the untensioned condition and compressibly securable at any section along its length by the extension of the pocket member in cooperation with extension of the wall member upon inflation of the bladder.

11. The combination of claim 10 wherein the elongate flexible positioning member is a lengthy strap of generally rectangular cross-section which occupies most of the space between said seams.

12. The assembly of claim 11 wherein the wall of the bladder is made of plastic material having a outer surface roughened by a pattern and the said strap is made of a similar plastic material.

13. The combination of claim 12 wherein at least the inside surface of the panel has a surface roughened by a pattern and is made from a plastic material.

14. The combination of claim 13 wherein the bladder, the strap and the panel are all made from the same material.

15. The combination of claim 4 further including an elongate flexible positioning member, positionable in each of said pockets for sliding contact between the pocket and the wall of the bladder in the untensioned condition and compressibly securable at any section along its length by the extension of the pocket member in cooperation with extension of the wall member upon inflation of the bladder.

16. The combination of claim 15 wherein the elongate flexible positioning members are lengthy straps of generally rectangular cross-section which occupy most of the space between said seams.

17. The assembly of claim 16 wherein the wall of the bladder is made of plastic material having a outer surface roughened by a pattern and the said strap is made of a similar plastic material.

18. The combination of claim 17 wherein at least the inside surface of the panel has a surface roughened by a pattern and is made from a plastic material.

19. The combination of claim 18 wherein the bladder, the strap and the panel are all made from the same material.

20. An inflatable bladder useful as a back rest, adjustably positionable along a pair of elongate flexible positioning members, comprising a bladder having an elongate pillow-shape, the bladder having a tensioned extensible wall in an inflated condition, the wall forming a front surface and an opposite back surface, being deflatable to an untensioned condition of said wall, and to a flat condition upon complete deflation;

a pair of extensible pockets spaced apart across the elongate back surface of said bladder, each of said pockets being fixed to said back wall at spaced apart seams, the pockets each having a panel across said seams for receiving a section of a flexible elongate positioning member in sliding contact between the pocket in the untensioned condition; and flexible elongate positioning members configured for placement between the inside surface of the pockets and the wall surface in sliding contact therewith in the untensioned condition, the pockets being extensible with said wall in the inflated condition of the bladder to compressibly secure a section of the positioning members in said pockets.

21. The combination of claim 20 further including a second inflatable bladder shaped like an elongate pillow and having a pair of spaced apart extensible pockets spaced on the back surface thereof to cooperate in lined up relationship with said flexible elongate positioning members, said positioning members being placed in sliding contact between the pockets and the back wall of the second inflatable bladder in the untensioned condition, and compressibly securing a section of a positioning member passing therethrough in the inflated condition of the bladder.

22. The combination of claim 21 further including a third inflatable bladder shaped like an elongate pillow and having a pair of spaced apart extensible pockets spaced on the back surface thereof to cooperate in lined up relationship with said flexible elongate positioning members, said positioning members being placed in sliding contact between the pockets and the back wall of the third inflatable bladder in the untensioned condition, and compressibly securing a section of a positioning member passing therethrough in the inflated condition of the bladder.

23. The combination of claim 20 further including one or more additional bladders having the same adjustable positioning and securing characteristics as said bladder.

24. The combination of claim 23 wherein one or more of the inflatable bladders includes a removable fabric cover in operable combination.

25. The combination of claim 20 wherein the bladder has one extensible pocket in a first location and another extensible pocket in a second location spaced from said first location, the first and second locations being centered along an imaginary arc along the surface of the bladder when inflated.

26. The combination of claim 20 wherein the elongate flexible positioning member is a lengthy strap of generally rectangular cross-section which occupies most of the space between said seams.

27. The assembly of claim 26 wherein the wall of the bladder is made of plastic material having a outer surface roughened by a pattern and said strap is made of a similar plastic material.

28. The combination of claim 27 wherein at least the inside surface of the panel has a surface roughened by a pattern and is made from a plastic material.

29. The combination of claim 26 wherein the bladder, the straps and the panel are all made from the same material.

30. An inflatable bladder useful as a back rest, adjustably positionable along a pair of elongate flexible positioning members, comprising a bladder having an elongate pillow-shape, the bladder having a tensioned extensible wall in an inflated condition, the wall forming a front surface and an opposite back surface, being deflatable to an untensioned condition of said wall, and to a flat condition upon complete deflation;

a pair of extensible pockets spaced apart across the elongate back surface of said bladder, each of said pockets being held flat against said back wall by spaced apart seams, the pockets each having a panel across said seams for receiving a section of a flexible elongate positioning member in sliding contact between the pocket and the surface of the bladder in the untensioned condition; and flexible elongate positioning members configured for placement between the inside surface of the pockets and the bladder wall surface in sliding contact therewith in the untensioned condition, the wall being extensible in the inflated condition of the bladder to frictionally engage a section of a positioning member in each of said pockets.

31. The combination of claim 30 further including a second inflatable bladder shaped like an elongate pillow and having a pair of spaced apart extensible pockets spaced on a back surface thereof to cooperate in lined up relationship with said flexible elongate positioning members, said positioning members being placed in sliding contact between the pockets and the back wall of the second inflatable bladder in the untensioned condition, and frictionally engaging a section of a positioning member passing therethrough in the inflated condition of the bladder.

32. The combination of claim 31 further including a third inflatable bladder shaped like an elongate pillow and having a pair of spaced apart extensible pockets spaced on a back surface thereof to cooperate in lined up relationship with said flexible elongate positioning members, said positioning members being placed in sliding contact between the pockets and the back wall of the third inflatable bladder in the untensioned condition, and frictionally engaging a section of a positioning member passing therethrough in the inflated condition of the bladder.

33. The combination of claim 30 further including one or more additional bladders having the same adjustable positioning and frictionally engaging pockets as said bladder.

34. The combination of claim 33 wherein one or more of the inflatable bladders includes a removable fabric cover in operable combination.

35. The combination of claim 30 wherein the bladder has one extensible pocket in a first location and another extensible pocket in a second location spaced from said first location, the first and second locations being centered along an imaginary arc along the surface of the bladder when inflated.

36. The combination of claim 30 wherein the elongate flexible positioning members are lengthy straps of generally rectangular cross-section which occupy most of the space between said seams.

37. The assembly of claim 36 wherein the wall of the bladder is made of plastic material having a outer surface roughened by a pattern and said straps are made of a similar plastic material.

38. The combination of claim 37 wherein at least the inside surface of the panels have a surface roughened by a pattern and is made from a plastic material.

39. The combination of claim 36 wherein the bladder, the straps and the panel are all made from the same material.

* * * * *